US008459595B2

(12) United States Patent
Logosz et al.

(10) Patent No.: US 8,459,595 B2
(45) Date of Patent: Jun. 11, 2013

(54) KITE CONTROL DEVICE WITH FREE ROTATION

(76) Inventors: Tony Logosz, Hood River, OR (US); Amary Bernard, Portland, OR (US); John Doyle, White Salmon, WA (US)

( * ) Notice: Subject to any disclaimer, the term of this patent is extended or adjusted under 35 U.S.C. 154(b) by 380 days.

(21) Appl. No.: 12/660,300

(22) Filed: Feb. 24, 2010

(65) Prior Publication Data

US 2012/0049006 A1 Mar. 1, 2012

Related U.S. Application Data

(63) Continuation-in-part of application No. 11/975,076, filed on Oct. 17, 2007, now Pat. No. 7,971,829.

(51) Int. Cl.
*A63H 27/08* (2006.01)
*B64C 31/06* (2006.01)

(52) U.S. Cl.
USPC ..... 244/155 A

(58) Field of Classification Search
USPC ..... 244/153 R, 155 R, 155 A
See application file for complete search history.

(56) References Cited

U.S. PATENT DOCUMENTS

| | | | | |
|---|---|---|---|---|
| 6,260,803 | B1 * | 7/2001 | Hunts | 244/155 R |
| 6,273,369 | B1 * | 8/2001 | Nishimura et al. | 244/155 A |
| 6,513,759 | B2 * | 2/2003 | Starbuck | 244/155 A |
| 6,581,879 | B2 * | 6/2003 | Bellacera | 244/155 A |
| 6,691,954 | B1 * | 2/2004 | Harrington et al. | 244/155 A |
| 6,745,713 | B2 * | 6/2004 | Starbuck | 114/39.16 |
| 6,830,220 | B2 * | 12/2004 | Runyan | 244/155 A |
| 6,869,047 | B2 * | 3/2005 | Pouchkarev | 244/155 A |
| 6,877,697 | B2 * | 4/2005 | Bellacera | 244/155 A |
| 6,988,694 | B2 * | 1/2006 | Barrs et al. | 244/155 A |
| 7,036,771 | B1 * | 5/2006 | Pouchkarev | 244/155 A |
| 7,182,294 | B2 * | 2/2007 | Blackman | 244/155 A |
| 7,581,701 | B2 * | 9/2009 | Logosz et al. | 244/155 A |
| 7,971,829 | B2 * | 7/2011 | See et al. | 244/155 A |
| 2004/0182968 | A1 * | 9/2004 | Gentry | 244/155 A |
| 2004/0195459 | A1 * | 10/2004 | Pouchkarev | 244/153 R |
| 2005/0040291 | A1 * | 2/2005 | Hansel | 244/155 A |
| 2006/0226294 | A1 * | 10/2006 | Logosz et al. | 244/152 |
| 2006/0243862 | A1 * | 11/2006 | Roger | 244/155 A |
| 2007/0120016 | A1 * | 5/2007 | Eberle et al. | 244/153 R |
| 2008/0067291 | A1 * | 3/2008 | Logosz et al. | 244/155 A |

FOREIGN PATENT DOCUMENTS

WO WO 2005058695 A1 * 6/2005

* cited by examiner

*Primary Examiner* — Joseph W Sanderson

(57) ABSTRACT

The present invention is a safety system for use in conjunction with a control bar for a kite wherein the two front lines are secured by a front line swivel positioned between the bar and the kite. One front line terminates at the swivel and one extension of the other front line, the center line, travels through a central aperture in the swivel. The center line is then routed through an aperture on the control bar and terminated with an end that can be secured to the user either manually or by a leash arrangement. The swivel allows any twists that may form in the front lines to unwind. An increased diameter element located proximally of the swivel is configured to engage the center swivel, but is configured to pass through the aperture on the control bar. When the bar is released, sufficient slack is imparted into the remaining flying lines to effectively depower the kite while retaining attachment to the kite through the restrained front line.

16 Claims, 4 Drawing Sheets

KITE CONTROL DEVICE WITH FREE ROTATION

CROSS-REFERENCE TO RELATED INVENTIONS

This application is a continuation-in-part of patent application U.S. Ser. No. 11/975,076, filed Oct. 17, 2007 now U.S. Pat. No. 7,971,829.

FIELD OF THE PRESENT INVENTION

The present invention relates generally to devices for controlling inflatable power or traction kites. More particularly, the invention relates to a kite control device featuring a safety depower function having a swiveling system that allows the flying lines to freely rotate to minimize tangles.

BACKGROUND OF THE INVENTION

Considerable effort is being expended to develop wings capable of generating tractive force for the purposes of powering a user on a variety of vehicles that are tethered solely by flexible lines. Such wings can generally be considered kites. The development of kites capable of generating significant force has made possible numerous recreational pursuits. For example, kite surfing or kite boarding refers to a sport involving the use of a wind powered wing to pull the participant on a vehicle across a body of water. Similar sports involving the use of appropriately configured vehicles to traverse sand, earth, snow and ice are also being pursued. One of skill in the art will also recognize that wind powered wings can be used in any number of other applications, whether recreational or practical. With the development of these applications has come an increasing demand for kites having improved characteristics.

One type of kite that has achieved popularity is a leading edge inflatable ("LEI") kite, typically comprising a semi-rigid framework of inflatable struts or spars that support a canopy to form the profile of the wing. This basic design is disclosed in U.S. Pat. No. 4,708,078 to Legaignoux, et al. The development of the LEI kite is generally credited with spurring the development of modern kite surfing due to its ability to be relaunched from the water's surface.

Most LEI kites currently employ four or five lines to control the kite. Two steering lines are attached at opposing ends of the kite at the trailing edge and at opposing ends of a control bar. Two front lines are attached at opposing ends of the kite at the leading edge and are secured to the middle of the control bar or to the user. The kite is steered by pivoting the control bar about a central axis to transmit force along the steering lines to the trailing edge of the kite. Further, by varying the relative length of the steering lines with respect to the front lines, the angle of attack of the kite can be adjusted, or "trimmed." This has the effect of providing control over the amount of lifting force developed by the kite. Most kite control systems have a "fixed" adjustment mechanism for setting the trim of the kite by using a cleat, adjustable strap, or the like, which is positioned above the bar, meaning between the bar and the kite. Most control systems also provide "variable" dynamic trim adjustment by providing an attachment for the front lines to the user, typically through a "chicken loop." Thus, the trim of the kite is constantly adjusted by moving the control bar in and out from the user's body.

The issue of safety is an important factor in the design of a LEI kite system. Power kites are capable of generating large forces that contribute to the enjoyment of the sport. However, these same forces can also pose significant safety hazards to the user and to bystanders when inadequate control is provided. This can occur if the wind strength increases beyond an acceptable amount, if the user does not or cannot utilize the control system appropriately or if the control system becomes compromised, such as by twisting, tangling or breaking the lines. Therefore, most kite designs and control systems offer a means for substantially reducing the amount of power exerted by the kite. Proven safety designs include methods of restraining one of either the front lines or the steering lines while allowing a significant amount of slack in the remaining lines. Ideally, this has the effect of corrupting the aerodynamic profile of the kite so that essentially all the lifting forces are extinguished.

Co-pending U.S. patent application Ser. No. 11/975,076, filed Oct. 17, 2007, which is hereby incorporated by reference in its entirety, discloses a safety system in which an extension of one of the front lines, the restrained front line, is routed through the control bar, so that it can be secured by the user independently from the control bar. Thus, this system is termed herein a center line safety system. A stopper housing positioned between the control bar is configured to allow passage of the flying line and/or a line extension but to engage an increased diameter element on the flying line.

In use, an increased diameter portion of the extension located between the bar and the stopper housing butts against the stopper housing allowing for normal control of the kite, including steering, dynamic trim using the chicken loop and fixed trim using a front line length adjustment mechanism as known in the art to control the sheeting of the kite. When the user wishes to activate the safety function, the user simply releases the bar and disconnects from the chicken loop if necessary. These operations release tension on all the flying lines except the restrained front line and extension, which is conventionally secured to the user by a safety leash. The remaining three lines remain secured to the control bar which generally travels up the restrained front line until sufficient slack has developed to depower the kite. Once the user wishes to relaunch the kite all that is necessary is to pull back in the control bar so that the slack is taken out of the remaining three lines and the kite then can be launched in a conventional manner.

As will be appreciated by those of skill in the art, this center line safety system offers a number of advantages and is convenient while still offering effective emergency depower capabilities. However, there are still areas where performance could be improved. One specific condition that proves challenging for conventional safety systems is the relative rotation between the kite and the user. Such rotation occurs either when the user pilots the kite in such a manner as to cause the kite to complete a rotation in the sky, such as by performing a kite loop or down loop, or when the user performs an acrobatic maneuver involving the user rotating, such as flipping or rolling. Further, these various maneuvers can be linked or combined leading to multiple relative rotations between the user and the kite.

The result of these rotations is that one or more twists are formed in the flying lines. Although the kite can still be controlled, friction between the lines degrades the performance and response making it desirable to untwist the lines quickly and easily. Untwisting the steering lines is relatively trivial. By simply spinning the control bar around the axis formed by the chicken loop line the appropriate number of times in the appropriate direction, any twists in the steering lines are quickly removed. However, since the front lines are routed through the control bar rather than secured to it, the twists in the front lines generally cannot be undone by spinning the control bar.

Some current solutions ignore the twists formed in the front lines, but this is less desirable because the twists, especially if they become numerous, can degrade performance or interfere with the proper operation of the safety depower. Another solution utilizes a swivel connection at the attachment between the chicken loop and the chicken loop line. The swivel can permit twists in the front lines to unwind, however, since the swivel is separated from the front lines by the chicken loop line, there is often insufficient force transmitted to the swivel to automatically unwind the lines. Typically, the user must manually untwist the swivel. As will be recognized, this situation is not optimal as the user must actively determine the direction and number of twists to be undone, diverting attention from piloting the kite and riding the board. Furthermore, a swivel connection between the chicken loop line and the chicken loop does not prevent the safety leash from wrapping around the chicken loop line with each relative rotation between the user and the kite.

Accordingly, what has been needed is a kite control that facilitates untwisting the control lines of the kite after a relative rotation has occurred between the user and the kite. What has also been needed is a kite control system that is optimized for use with a center line safety system. This invention satisfies these and other needs.

SUMMARY OF THE INVENTION

In accordance with the above objects and those that will be mentioned and will become apparent below, the present invention is a control device for use with an aerodynamic wing that includes a bar with opposing ends adapted to apply steering forces to the aerodynamic wing, at least two flying lines used to transmit forces to and from the aerodynamic wing and a swivel having a distal portion secured to a proximal portion such that the distal portion can rotate freely with respect to the proximal portion and a central aperture around which the distal portion rotates, wherein a first flying line of the at least two flying lines is routed through a guide on the distal portion of the swivel and through the central aperture of the swivel, wherein swivel is secured to the bar, and wherein the first flying line has an increased diameter element positioned between the guide and the bar which is configured to engage the guide and prevent travel of the increased diameter element through the guide. Preferably, the swivel comprises a bearing and race system, such as a thrust bearing. Also preferably, the increased diameter portion of the first flying line is less than approximately four times the diameter of the first flying line.

In one aspect, the flying lines comprise two steering lines disposed at the opposing end of the bar and a first and second front lines and wherein the first flying line is the first front line. Preferably, the second front line is secured to the distal portion of the swivel. Also preferably, the control device further includes a chicken loop line extending through the aperture on the bar and secured to the swivel. In such embodiments, the effective length of the chicken loop line can be adjustable. In a specific embodiment, the chicken loop line is secured to a chicken loop, travels through the aperture on the bar, through a slidable attachment on the proximal portion of the swivel, back through the aperture and is secured by a releasable attachment located adjacent the chicken loop, configured so that a user can detach the chicken loop line from the releasable attachment at a first attachment point, adjust a length of the chicken loop line and secure the chicken loop line to the releasable attachment at a second attachment point. Preferably, the slidable attachment on the swivel comprises a pulley and the releasable attachment adjacent chicken loop comprises a cleat.

In another aspect of the invention, the proximal portion of the first flying line is a line extension. Preferably, the connection between the first flying line and the line extension forms the increased diameter portion.

The invention also includes a method for controlling an aerodynamic wing comprising the steps of providing a bar with opposing ends adapted to apply steering forces to the aerodynamic wing, at least two flying lines used to transmit forces to and from the aerodynamic wing and a swivel having a distal portion secured to a proximal portion such that the distal portion can rotate freely with respect to the proximal portion and a central aperture, wherein a first flying line of the at least two flying lines is routed through a guide on the distal portion of the swivel and through the central aperture of the swivel, wherein swivel is secured to the bar, and wherein the first flying line has an increased diameter element positioned between the guide and the bar which is configured to engage the guide and prevent travel of the increased diameter element through the guide, operating the aerodynamic wing in a manner that creates a relative rotation between the aerodynamic wing and the bar and causes a twist involving the first flying line, and rotating the distal portion of the swivel with respect to the proximal portion of the swivel to unwind the twist involving the first flying line.

In a further embodiment, the bar has flying lines including two steering lines disposed at the opposing end of the bar and a first and second front lines wherein the first flying line is the first front line and wherein second front line is secured to the distal portion of the swivel and the method further comprises the step of unwinding any twists formed involving the steering lines by rotating the bar.

In yet another embodiment, the method includes the steps of attaching a safety tether between a user and the first flying line to restrain the first flying line and depowering the aerodynamic wing by releasing the bar so that the first flying line runs through the central aperture of the swivel and the bar aperture to create slack in flying lines other than the first flying line.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE INVENTION

Figure 1:
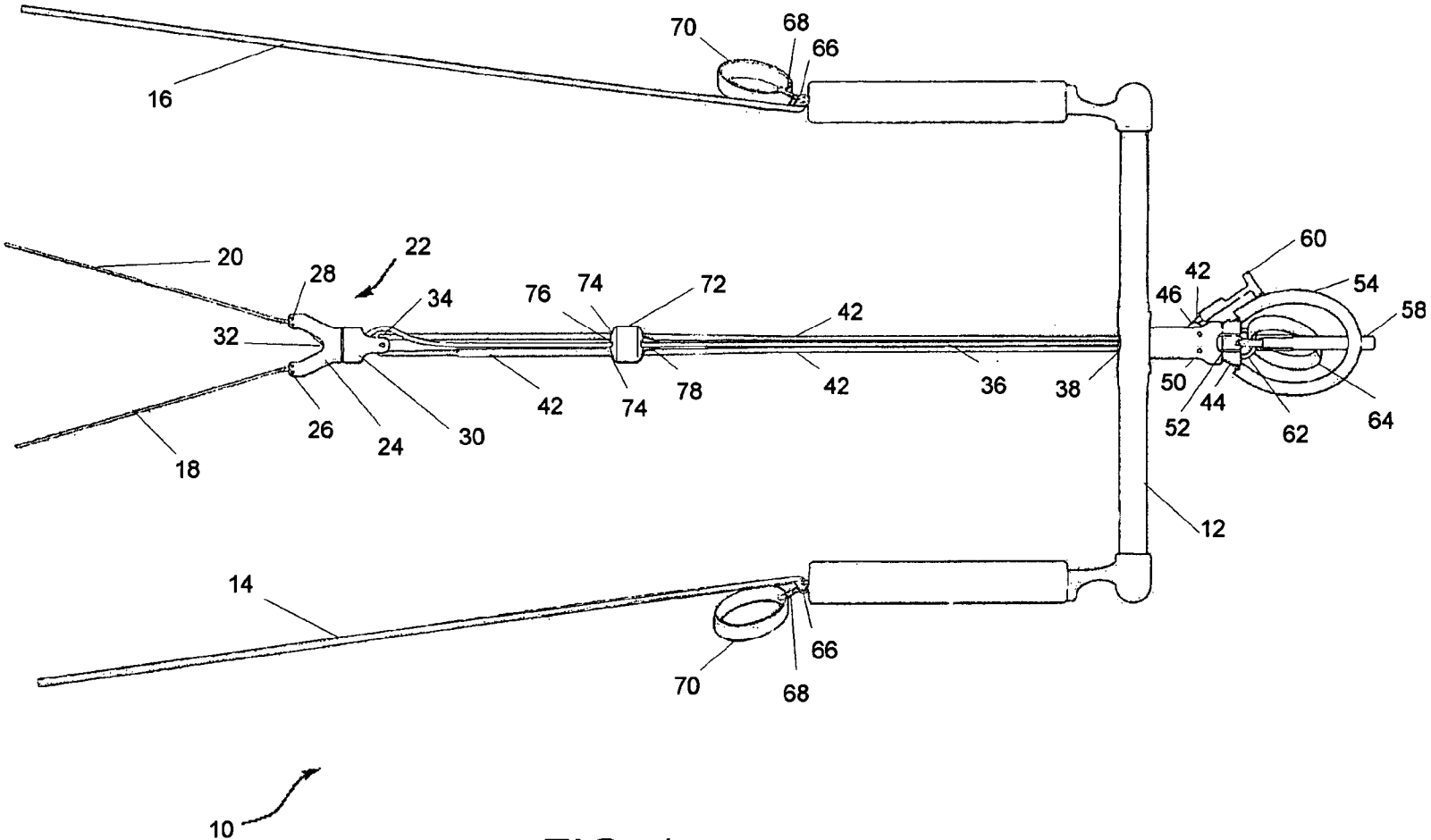
FIG. 1 is a perspective view showing a kite control bar having a center-routed safety system having a center swivel, according to the invention.

Before describing the present invention in detail, it is to be understood that this invention is not limited to particularly exemplified materials, methods or structures as such may, of course, vary. Thus, although a number of materials and methods similar or equivalent to those described herein can be used in the practice of the present invention, the preferred materials and methods are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms "a, "an" and "the" include plural referents unless the content clearly dictates otherwise.

As used herein, the term "cleat" is meant to mean and include any readily releasable attachment mechanism for temporarily securing a line in a desired position. As such, these devices include, without limitation, friction cleats, cam cleats, buckles or the like, such that the length of a line can be mechanically fixed at a desired amount and subsequently released.

As used herein, the term "chicken loop line" is meant to mean and include any line configured to transmit force from the front lines to the user.

As used herein, the term "chicken loop" is meant to mean and include any attachment point for releasably securing the kite to a user, so that the force generated by the kite is transmitted to the user during normal operation. In one embodiment, the chicken loop line is reinforced with tubing and formed into a loop to allow easy engagement with a harness hook. Preferably, as described below, the chicken loop includes a safety-release mechanism that opens the loop and releases the user when activated. In another embodiment, the chicken loop line is terminated in a metal ring that is designed to cooperate with a releasable shackle secured to the user. Any other suitable attachment mechanisms are also included. This term is not meant to include a safety line or attachment designed to depower the kite when the control bar is released.

The present invention is a safety system for use in conjunction with a control bar for a kite wherein the two front lines are secured by a front line swivel positioned between the bar and the kite. One front line terminates at the swivel and one extension of the other front line, the center line, travels through a central aperture in the swivel. The center line is then routed through an aperture on the control bar and terminated with an end that can be secured to the user either manually or by a leash arrangement. As will be appreciated from the discussion below, the swivel device allows the front lines to rotate freely, preventing twists from forming. An increased diameter element located proximally of the swivel is configured to engage the center swivel, but is configured to pass through the aperture on the control bar. As will be described in detail below, this arrangement allows the restrained front line to function normally when the kite is flying. When the bar is released, the bar and swivel, to which the remaining flying lines are attached, can travel distally along the restrained front line since the center line and restrained front line slides through the central aperture on the swivel and the bar aperture. This causes sufficient slack to be imparted into the remaining flying lines to effectively depower the kite while retaining attachment to the kite through the restrained front line.

Figure 2:
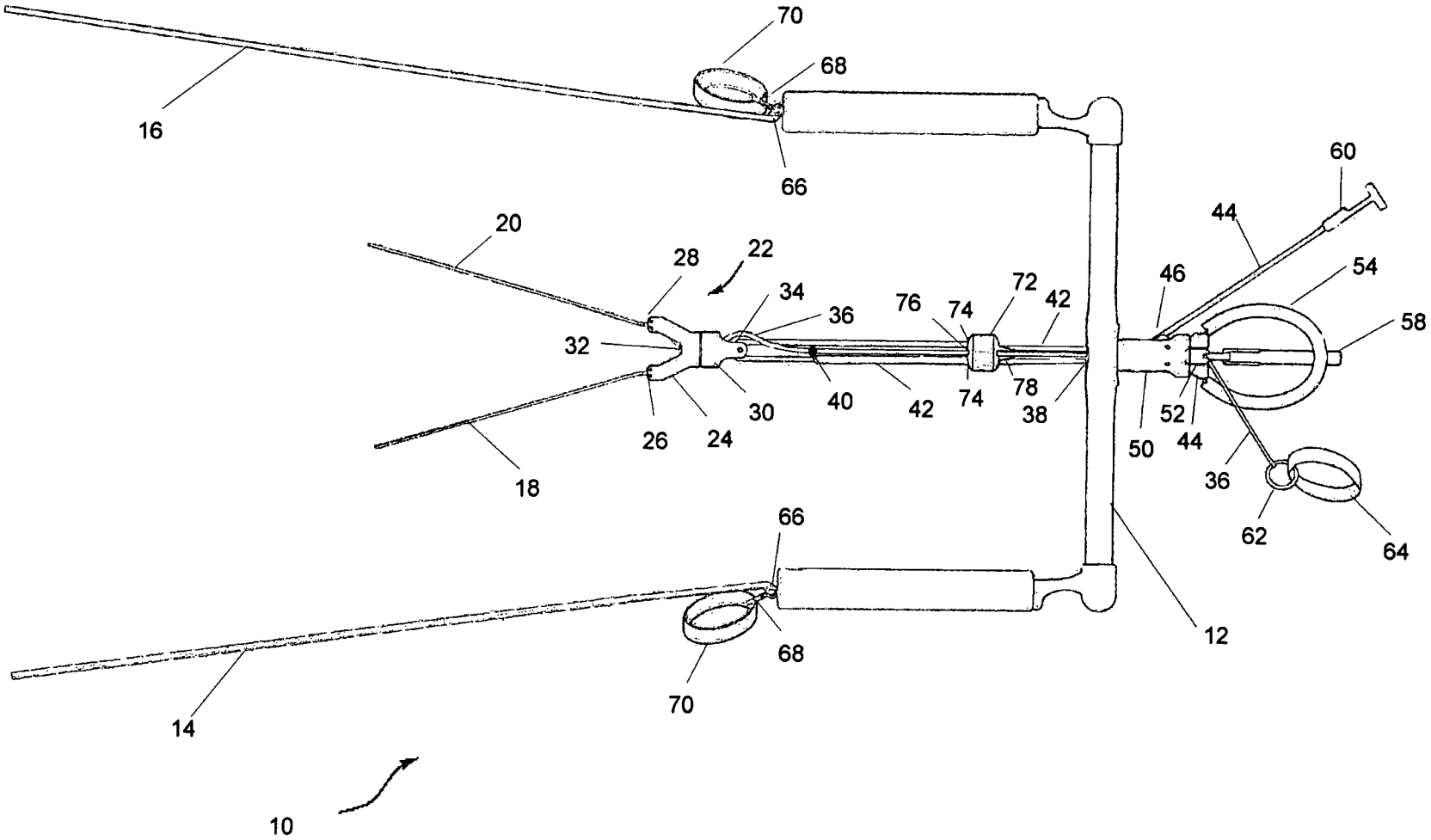
FIG. 2 is a perspective view showing of the kite control bar shown in FIG. 1, illustrating an extended depower line and an extended center line.

FIGS. 1 and 2 illustrate a system 10 including a control device in the form of bar 12, configured to transmit forces to and from steering lines 14 and 16 and front lines 18 and 20 to control a kite. In particular, pivoting bar 12 tensions one steering line and slackens the other, causing the kite to turn. Front lines 18 and 20 extend from the leading edge of the kite and engage swivel 22 at a location between bar 12 and the kite. Depending upon the type of kite, front lines 18 and 20 may be directly attached at or adjacent the leading edge of the kite or may be secured to a suitable bridle arrangement that is in turn attached to points along or adjacent the kite's leading edge. As shown, swivel 22 includes a distal portion 24 having two guides 26 and 28 for engaging the front lines. Distal portion 24 is pivotally attached to proximal portion 30, allowing relative rotational movement between proximal portion 30 and distal portion 24. Swivel 22 also features a central aperture 32, shown more clearly in FIG. 4. Proximal portion 30 has a pulley 34, or other suitable sliding attachment point, such as a ring. Front line 18 terminates at swivel 22, and for example, may be secured to guide 26 of distal portion 24 in any suitable manner, including a knot, a loop formed in the proximal end of front line 18, a stop on front line 18 that is proximal of guide 26 and is sized to engage the guide, or any other means of attachment, as known in the art. Front line 20, the restrained front line, features a line extension, center line 36 which runs through guide 28, central aperture 32 and finally through aperture 38 on bar 12. As will be appreciated, center line 36 can either be an extended portion of front line 20 or a separate line member. Preferably, center line 36 is formed from an elasticized material, such as a bungee, so that center line 36 remains relatively taut regardless of the fixed trim adjustment described below. By preventing slack from developing in center line 36, the risk of tangling center line 36 with the user or other parts of the kite control system is minimized. An increased diameter element 40 on front line 20, positioned proximal to guide 28, is sized to engage the guide 28 so that front line 20 cannot extend through guide 28 once increased diameter element 40 is in contact with guide 28. Central aperture 32 and bar aperture 38 are sized to allow increased diameter element 40 to travel freely through them.

In the shown embodiment, swivel 22 is secured to bar 12 using a chicken loop system that incorporates fixed trim adjustment and dynamic trim adjustment. The chicken loop portion of system 10 includes chicken loop line 42 that is secured at a first end to chicken loop chassis 44, located on the proximal side of the bar 12. Chicken loop line 42 travels through bar aperture 38, around pulley 34 of swivel 22, back through bar aperture 38 and is adjustable secured to chicken loop chassis 44 by cleat 46, or other suitable means as known in the art. Preferably, chicken loop chassis 44 also features an aperture 48 through which center line 36 to facilitate line management.

As will be appreciated, the embodiment of the invention shown features a "push-away" chicken loop release system. Current trends in kite surfing design have led to the adoption of systems having "push-away" functionality to provide standardization for this important safety feature. A release handle 50 that slides over chicken loop chassis 44 is elastically biased towards the user, such as by elastic cord 52. Additional details of the chicken loop chassis 44 and the release handle 50 are shown in the detail views of FIGS. 5 and 6, respectively. The chicken loop 54 is preferably formed from a length of line and covered with polymer tubing, and secured at one end to chicken loop chassis 44. In the embodiment shown, the other end of chicken loop 54 terminates in a ring that is captured by pivoting pin 56 that is normally held in a closed configuration by release handle 50. When release handle 50 is moved away from the user, pivoting pin 56 is freed, allowing the end of chicken loop 54 to be released, opening the loop. Preferably, chicken loop 54 includes a retainer 58 that can be interlaced with chicken loop 54 when engaged with a user's harness hook to prevent chicken loop 54 from coming inadvertently unhooked. As will be appreciated, operation of the chicken loop release function serves to automatically disconnect the user from the kite without the need to manually unhook chicken loop 54, a process that can be difficult or impossible in emergency situations when the kite is exerting more force on the user than can be managed effectively.

As will be appreciated from a comparison of FIGS. 1 and 2, the fixed trim function of system 10 operates to change the static relative length of front lines 18 and 20 as compared to steering lines 14 and 16. Chicken loop line 42 terminates in a handle 60. When the user disengages chicken loop line 42 from cleat 46, draws a portion of chicken loop line 42 through cleat 46 and secures it again. Accordingly, swivel 22, and thus the attachment point of front lines 18 and 20, is drawn towards the user, decreasing the relative length front lines 18 and 20 with respect to steering lines 14 and 16. This has the effect of "sheeting out" the kite, and typically configures the kite to generate less power at a given wind speed.

Furthermore, this fixed trim function operates independently of the dynamic trim sheeting control that is offered by moving the bar 12 relative to chicken loop line 42. As will be appreciated, sliding control bar 12 up and down chicken loop line 42 changes the length of steering lines 14 and 16 relative to front lines 18 and 20 and sheets the kite by changing the angle of attack, dynamically varying the trim. This functionality is enabled by the use of the chicken loop system to secure swivel 22 to control bar 12. As discussed above, dynamic trim is achieved by moving control bar 12 relative to chicken loop 54, which is generally secured to the user by hook and harness system. In alternative embodiments, the system may not employ a chicken loop system and thus may not have dynamic trim. In such embodiments, swivel 22 is secured directly to control bar 12, preferably by a line that has a length which is user adjustable so that static, fixed trim functionality is still available.

Similarly, FIGS. 1 and 2 also show center safety system in normal operation and as the system is being deployed, respectively. As discussed above, during normal operation, increased diameter element 40 on front line 20 or center line 36 engages swivel 22 at guide 28, preventing front line 20 from extending further. Typically, in this condition, the effective length of front lines 18 and 20 will be equal. Center line 26 runs from increased diameter element 40, through central aperture 32 on swivel 22, through bar aperture 38 and finally through aperture 48 on chicken loop chassis 44. Preferably, center line 36 terminates in a ring 62, to which handle 64 is attached. Typically, a user will clip a safety leash onto ring 62 so that center line 36 is tethered to the user independently of other connections to bar 12, such as hooking into chicken loop 54. Handle 64 allows the user a convenient means to manually restrain center line 36 if desired, such as in known self-landing techniques or when the center safety system is being reset. During normal operation, when the kite is flying, tension is applied to all flying lines. When the user wishes to activate the center safety system and substantially completely depower the kite, the user disengages from bar 12, such as by unhooking from chicken loop 54 or by activating the chicken loop release described above, and releases the bar. Since the kite is exerting tension in all the flying lines, the bar will be pulled away from the user, while center line 36 is restrained. As can be seen in FIG. 2, system 10 has begun to slide up center line 36, away from the user. Increased diameter element 40 has disengaged from guide 28 and traveled through central aperture 32. As the process continues, center line 36 and subsequently front line 20 will continue to feed through central aperture 32, bar aperture 38 and chassis aperture 48. This motion will cause tension to be released and slack to develop in the remaining flying lines, including steering lines 14 and 16 and the unrestrained front line, line 18. This slack causes the kite to "flag" or otherwise thoroughly depower. Kites employing this system will be designed so that when they are restrained by only a single line, such as front line 20, and there is slack in the remaining flying lines, the kite will not generate the aerodynamic lifting force that exists when the kite is flying, thus substantially completely depowering the kite.

After deployment of the center safety system, the user can regain control of the kite and relaunch it. By pulling along center line 36 and front line 20, the user can grasp bar 12 again and will typically hook into chicken loop 54. The excess front line 20 and center line 36 can now be fed back through the system until increased diameter element 40 reengages guide 28, placing all flying lines at their intended relative length for normal kite operation. The kite can then be relaunched using known techniques.

Additional details of the system 10 are also shown in FIGS. 1 and 2. Preferably, steering lines 14 and 16 are routed through apertures 66 on the ends of bar 12. The ends of steering lines 14 and 16 are secured to bar 12 by termination in rings 68 that cannot travel through apertures 66. Handles 70 attached to rings 68 give the user a convenient means to restrain one of the steering lines. By pulling one of the steering lines through aperture 66, the user can selectively shorten one of the steering lines relative to the remaining flying lines to a greater degree than would be possible from the normal steering operation of pivoting bar 12. As one of skill in the art will appreciate, this can be desirable to aid in the relaunching or self-landing of the kite.

Another aspect of system 10 is the active stopper 72, having guides or lumens 74 and 76 configured to receive the doubled chicken loop line 42 and center line 36, respectively. The guides allow stopper 72 to be slid relatively freely along chicken loop lines 42, but provide sufficient friction to hold stopper 72 at the desired location when the user is not adjusting the position. Stopper 72 also comprises a wedge portion 78 configured to engage with aperture 38 in control bar 12, which is preferably tapered to receive wedge portion 78. The surfaces of aperture 38 and wedge 78 can have ridges or other features configured to increase friction with chicken loop line 42 when wedge 78 is engaged in aperture 38. In use, stopper 72 can be positioned at any desired position along chicken loop lines 42. When control bar 12 is drawn against stopper 72, wedge 78 engages aperture 38, locking stopper 72 in position along chicken loop lines 42. While in this position, control bar 12 will rest against stopper 72 allowing the kite to remain sheeted at the desired angle without requiring the user to exert a pulling force. When the user does wish to sheet out to a greater degree, the user simply slides stopper 72 to a new position.

Alternatively embodiment, stopper 72 can be substituted with a more conventional fixed stopper. As such, the fixed stopper is releasably secured to the chicken loop line 42 by any suitable mechanism including a screw-actuated fastener, a cam clamp, other friction-based clamps and the like.

Further details regarding sheeting mechanisms and control bar configurations can be found in U.S. patent application Ser. Nos. 11/100,911, filed Apr. 6, 2005 and 11/267,947, filed Nov. 3, 2005, which are hereby incorporated by reference in their entirety.

The chicken loop line 42 configuration and cleat 46 can be used in a conventional manner to control the angle of attack of the kite. Generally, a user employs the cleat 46 to adapt the kite to the prevailing wind conditions and moves the control bar 12 up and down chicken loop line 42 to provide immediate control over the kite's angle of attack, allowing the user to spontaneously generate more or less power in the kite as desired. Accordingly, the sheeting angles available by sliding control bar 12 up and down chicken loop line ranges from a minimum established when the bar is fully sheeted in to a maximum that depends upon the throw of the bar along the chicken loop line. Active stopper 72 is used to adjust the amount of throw available, and thus, the range of dynamic trim control. Typically, a control bar 12 is tuned so that maximum power is developed in the kite when a minimum of chicken loop line 42 is drawn through cleat 46, providing the greatest extension of front lines 18 and 20, and when control bar 12 is fully sheeted in to maximize the length of front lines 18 and 20 relative to steering lines 14 and 16. Likewise, the kite has the least amount of power when bar 12 is fully sheeted out and a maximum of chicken loop line 42 is drawn through cleat 46. Therefore, the range of sheeting angles available by sliding control bar 12 up and down chicken loop line 42 can effectively be translocated by drawing a portion of chicken loop line 42 through cleat 46 and securing it.

Figure 4:
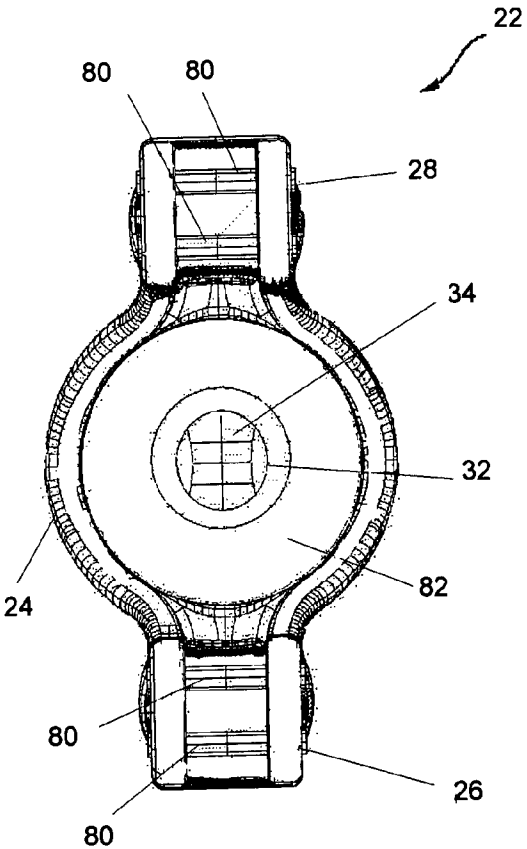
FIG. 4 is a detail top view of a center swivel, according to the invention.
Figure 3:
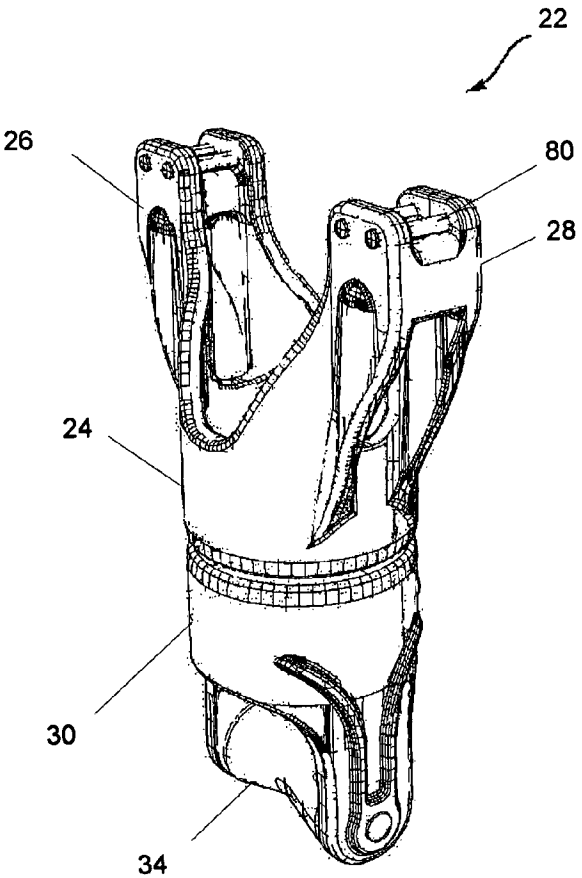
FIG. 3 is a detail three-quarter view of a center swivel, according to the invention.

Turning now to FIGS. 3 and 4, detailed three-quarters and top elevational views of swivel 22 are shown, respectively. In the embodiment shown, guides 26 and 28 are substantially symmetrical. Alternatively, one of skill in the art will recognize that different structures can be used to achieve the desired functionality. Here, guides 26 and 28 are formed by pairs of pins 80 secured to the housing of distal portion 24. The pairs of pins 80 are spaced apart to form apertures for the passage of front line 20 and engagement with increased diameter element 40. The rotating connection between distal portion 24 and proximal portion 30 is preferably formed by bearing housing 82. Any suitable rotational bearing system can be used, however, given the relatively high axial loads, a thrust bearing such as roller or ball bearing and race system is preferred. Alternatively, other means of achieving a pivoting connection between distal portion 24 and proximal portion 30 can be used as known to those of skill in the art, including bushings. Bearing housing 82 includes central aperture 32. As described above, pulley 34 facilitates the smooth operation sheeting using chicken loop line 42, but any suitable sliding means for engaging chicken loop line 42, such as a ring, can be used. Preferably, the geometry of guide 28 and central aperture 32 are configured to impart a desired amount of friction to the sliding action of front line 20. Generally, the amount of friction is low enough to allow smooth and rapid travel of swivel 22 over front line 20 when central safety system is initially deployed and the kite is exerting maximum tension on the flying lines. However, enough friction to prevent the further travel of swivel 22 along front line 20 once the kite has been sufficiently depowered is desirable. As will be appreciated, this prevents control bar 12 from traveling too far away from the user after safety deployment, facilitating retrieval of the bar.

Since the forces experienced by flying line 20 are considerable, the interaction between guide 28 and increased diameter element 40 must be robust and preferably be able to withstand forces up to the breaking strength of the flying line. Similarly, the attachment of front line 18 to guide 26 must be similarly robust. In one embodiment of the invention, increased diameter element 40 comprises a knot in the flying line. In other embodiments, increased diameter element 40 is integrally formed in the flying line by weaving a structure into the line. In yet other embodiments, increased diameter element 40 is formed by securing a structure to the line at the desired location.

Although the engagement between increased diameter element 40 and guide 28 must be robust for the reasons given above, it is also desirable to minimize the diameter of increased diameter element 40 to facilitate its passage through the other components of system 10, such as apertures 32, 38, 48 and 76. Accordingly, in a preferred embodiment, increased diameter element 40 is less than approximately 4 times the diameter of flying line 18 (or the minimum diameter of the aperture in guide 28). More preferably, increased diameter element 40 is less than approximately 3 times the diameter of flying line 18 and even more preferably is approximately 2 times the diameter.

Figure 5:
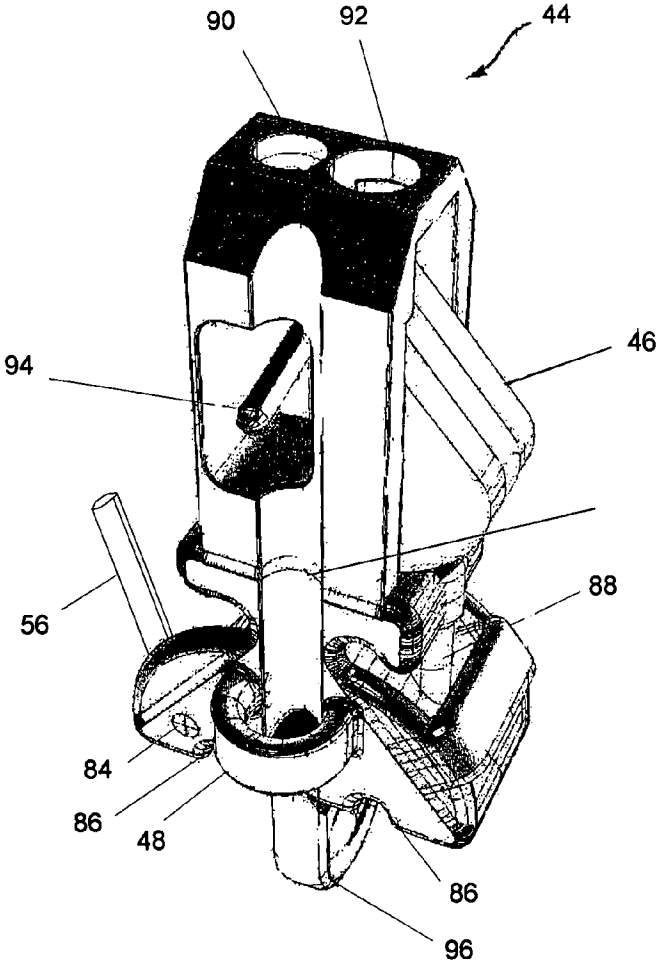
FIG. 5 is a detail three-quarter view of a chicken loop chassis, according to the invention.

FIG. 5 shows a detailed three-quarter elevational view of chicken loop chassis 44. The major functional features have been described above. As can be seen, pivoting pin 56 is attached by hinge 84. The housing of chassis 44 also includes guides 86 configured to receive elastic cord 52, which is used to hold release handle 50 in its closed position. As described above, one end of chicken loop 54 is secured to chassis 44, for example by threaded screw 88, or any other suitable means. The other end of chicken loop 54 engages pivoting pin 56. When pin 56 is retained by release handle 50, chicken loop 54 is complete and the user can hook in to employ the dynamic sheeting capabilities the chicken loop system provides. When release handle is moved away from the user ("push-away"), pin 56 is release and free to pivot on hinge 84. This releases the end of chicken loop 54, opening the loop and disengaging the user.

In a further aspect of the shown embodiment, a tool free implementation is provided. As can be seen, chassis 44 has two apertures 90 and 92 to receive the opposing ends of chicken loop line 42. One aperture 90 leads to a recess in the chassis 44 having fixed pin 94. Accordingly, one end of chicken loop line 42 terminating in a loop can be secured by pin 94 and covered by release handle 50. The other end of chicken loop line 42, after passing through bar aperture 38 and around pulley 34, feeds through aperture 92 that leads to cleat 46, where chicken loop line 42 can be secured releasably. Thus, no tools are required to service or replace chicken loop line 42.

In the embodiment shown, chassis 44 includes a longitudinal recess 96 configured to facilitate the smooth travel of center line 36, increased diameter element 40 and front line 20 between chassis 44 and release handle 50, exiting though aperture 48. Aperture 48 also provides a positive stop against which handle 50 can rest when being biased towards the user by elastic cord 54. Chassis 44 also includes an attachment point 98 for retainer 58. Alternatively, a user can clip a leash to attachment point 98 in order to employ an unhooked riding style while maintaining an emergency connection to the chicken loop system.

Figure 6:
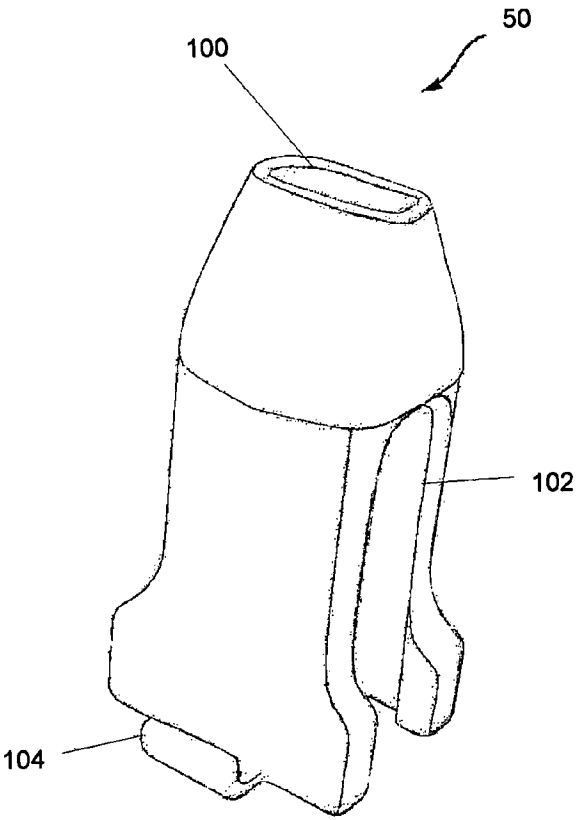
FIG. 6 is a detail three-quarter view of a release handle; according to the invention.

As shown in FIG. 6, release handle 50 is a housing configured to coaxially fit over the distal portion of chicken loop chassis 44. Opening 100 at the top of handle 50 accommodates the doubled chicken loop line 42 and center line 36. Similarly, cutaway 102 is configured to accommodate cleat 46 and chicken loop line 42. The other side of handle 50 is solid so that pin 56 is retained when handle 50 is in its proximal position relative to the user. Projections 104 capture elastic cord 52, which as described above, is used to bias handle 50 to its proximal position.

One of skill in the art will appreciate that system 10 as described above presents a number of advantages. In particular, swivel 22 allows the untwisting of any winds that occur in the front lines 18 and 20 due to relative rotations between the kite and the user. Since front line 20 and center line 36 is routed through central aperture 32 of swivel 22, rotation of distal portion 24 with respect to proximal portion 30 will not transmit any twists to the chicken loop line 42 or the center line 36. In turn, any twists that form in front lines 18 and 20 will automatically unwind. Further, swivel 22 is positioned at a point where front lines 18 and 20 begin to diverge. Accordingly, any unwinding force developed by the existence of twists in the front lines will be concentrated at that point, facilitating the unwinding process. Finally, the remaining desirable features of the center safety system described above are unaffected, as are the normal fixed trim and dynamic trim operations.

As one of skill in the art will appreciate, the safety systems of the invention can be applied to various kite designs, including C-type kites using four or five control lines, bow type kites, hybrid or supported leading edge (SLE) type kites, and others. For example, the invention can readily be adapted to a five-line controlled kite by conventionally securing the two front lines to swivel 22 and routing the fifth line through central aperture 32. Further, the system can also be used with conventional fixed trim adjustment systems that use mechanisms located between the bar and the kite to alter the effective length of the chicken loop line. It should also be appreciated that in the principle embodiments illustrated, the center flying lines are secured to the control bar by a chicken loop dynamic trim system. However, the systems of the invention can also be used in configurations wherein swivel 22 is directly attached to the control bar by a line extension, which preferably has a length that can be adjusted to provide fixed trim functionality.

Described herein are presently preferred embodiments, however, one skilled in the art that pertains to the present invention will understand that there are equivalent alternative embodiments. As such, changes and modifications are properly, equitably, and intended to be, within the full range of equivalence of the following claims.

What is claimed is:

1. A control device for use with an aerodynamic wing comprising:

a bar with opposing ends adapted to apply steering forces to the aerodynamic wing, at least two flying lines used to transmit forces to and from the aerodynamic wing, and a swivel having a distal portion secured to a proximal portion such that the distal portion can rotate freely with respect to the proximal portion and a central aperture extending through the proximal portion around which the distal portion rotates, wherein a first flying line of the at least two flying lines is routed through a guide on the distal portion of the swivel and through the central aperture of the swivel, wherein the swivel is secured to the bar, and wherein the first flying line has an increased diameter element positioned between the guide and the bar which is configured to engage the guide and prevent travel of the increased diameter element through the guide.

2. The control device of claim 1, wherein the swivel comprises a bearing and race system.

3. The control device of claim 1, wherein the swivel comprises a thrust bearing.

4. The control device of claim 1, wherein the increased diameter portion of the first flying line is less than approximately four times the diameter of the first flying line.

5. The control device of claim 1, wherein the at least two flying lines comprise two steering lines disposed at the opposing end of the bar and first and second front lines and wherein the first flying line is the first front line.

6. The control device of claim 5, wherein the second front line is secured to the distal portion of the swivel.

7. The control device of claim 6, wherein the control device further comprises a chicken loop line extending through an aperture on the bar and secured to the swivel.

8. The control device of claim 7, wherein effective length of the chicken loop line is adjustable.

9. The control device of claim 8, wherein the chicken loop line is secured to a chicken loop, travels through the aperture on the bar, through a slidable attachment on the proximal portion of the swivel, back through the aperture and is secured by a releasable attachment located adjacent the chicken loop, configured so that a user can detach the chicken loop line from the releasable attachment at a first attachment point, adjust a length of the chicken loop line and secure the chicken loop line to the releasable attachment at a second attachment point.

10. The control device of claim 9, wherein the slidable attachment on the swivel comprises a pulley.

11. The control device of claim 9, wherein the releasable attachment adjacent chicken loop comprises a cleat.

12. The control device of claim 1, wherein a proximal portion of the first flying line comprises a line extension.

13. The control device of claim 12, wherein a connection between the first flying line and the line extension forms the increased diameter portion.

14. A method for controlling an aerodynamic wing comprising the steps of:

a) providing a bar with opposing ends adapted to apply steering forces to the aerodynamic wing, at least two flying lines used to transmit forces to and from the aerodynamic wing and a swivel having a distal portion secured to a proximal portion such that the distal portion can rotate freely with respect to the proximal portion and a central aperture extending through the proximal portion around which the distal portion rotates, wherein a first flying line of the at least two flying lines is routed through a guide on the distal portion of the swivel and through the central aperture of the swivel, wherein the swivel is secured to the bar, and wherein the first flying line has an increased diameter element positioned between the guide and the bar which is configured to engage the guide and prevent travel of the increased diameter element through the guide;

b) operating the aerodynamic wing in a manner that creates a relative rotation between the aerodynamic wing and the bar and causes a twist involving the first flying line; and c) rotating the distal portion of the swivel with respect to the proximal portion of the swivel to unwind the twist involving the first flying line.

15. The method of claim 14, wherein the at least two flying lines comprise two steering lines disposed at the opposing end of the bar and first and second front lines wherein the first flying line is the first front line and wherein second front line is secured to the distal portion of the swivel; further comprising the step of unwinding any twists formed involving the steering lines by rotating the bar.

16. The method of claim 14, further comprising the steps of:

d) attaching a safety tether between a user and the first flying line to restrain the first flying line; and e) depowering the aerodynamic wing by releasing the bar so that the first flying line runs through the central aperture of the swivel and a bar aperture to create slack in flying lines other than the first flying line.

* * * * *